United States Patent [19]

Michael

[11] 4,120,312

[45] Oct. 17, 1978

[54] VACUUM-TYPE WATER REMOVAL SYSTEMS FOR BUILDINGS

[76] Inventor: Harald Richard Michael, Am Gosslers Park 9, 2000 Hamburg 55, Germany

[21] Appl. No.: 855,086

[22] Filed: Nov. 28, 1977

[30] Foreign Application Priority Data

Nov. 26, 1976 [DE] Fed. Rep. of Germany ..... 2653713

[51] Int. Cl.[2] ..... E03D 1/00

[52] U.S. Cl. ..... 137/236 R; 137/255; 137/205; 4/300; 4/431; 4/198

[58] Field of Search ..... 4/300, 321, 427, 431, 4/1; 137/205, 236, 255

[56] References Cited

U.S. PATENT DOCUMENTS

| | | | |
|---|---|---|---|
| 3,730,884 | 5/1973 | Burns | 4/321 X |
| 3,852,836 | 12/1974 | Oberholzer | 137/236 X |

*Primary Examiner*—Alan Cohan

*Attorney, Agent, or Firm*—Larson, Taylor and Hinds

[57] ABSTRACT

An improved vacuum-type waste water removal system is provided for use in buildings wherein waste water, collected from facilities such as toilets and bath tubs in the building, is fed by gravity feed lines to a collection chamber connected to a vacuum line for removal of the collected water, and wherein a check valve is connected between the collection chamber and the vacuum line which opens automatically when the water reaches a preselected maximum. The improvement concerns the provision of a backwash receptacle connected to either a gravity line or the collection chamber at a location above the maximum water level in the collection chamber and substantially below the facilities referred to. The volume of the backwash receptacle is large as compared with the collection chamber and the backwash receptacle serves to reduce operating noise and to provide overflow protection.

10 Claims, 3 Drawing Figures

VACUUM-TYPE WATER REMOVAL SYSTEMS FOR BUILDINGS

FIELD OF THE INVENTION

The invention relates to a vacuum-type water removal system for buildings, in which waste water from sanitary facilities and the like is fed by gravity feed lines to a collector or collection chamber, and the collector is connected to a water removal vacuum conduit at a selected maximum water level through an automatic check valve.

BACKGROUND OF THE INVENTION

A system of the type referred to above is described, for example, in German OS 2,455,551. It is noted that it is important in the operation of such system that only a relatively small quantity of waste water, e.g. 8 to 40 liters, and, thereafter, a specific quantity of air, be admitted to the vacuum conduit through the check valve, the latter opening only briefly. Thus, the collection chamber or receptacle forming the collector upstream of the check valve is correspondingly small.

Such prior art waste water removal systems have the drawback that, in normal use, the suction of air through the gravity feed lines subsequent to the waste water causes a loud, rather disturbing noise each time the check valve is opened. Moreover, there is the risk that if there is a blockage or other disturbance in the vacuum system or at the check valve, the waste water left over after the filling of the collector receptacle will remain in the gravity feed line and the water level therein will rise until water spills out from an overflow opening in the building.

SUMMARY OF THE INVENTION

The purpose of the waste water removal system of the invention is to solve the problems associated with conventional waste water removal systems of the type described above. In particular, the system of the invention is less noisy in normal operation and, at the same time, reduces the risk of overflow when there is a malfunction in the system.

Briefly stated, the invention concerns the provision of a vented backwash receptacle at a level above the maximum water level in the collection chamber, and sufficiently far below the sanitary facilities or the like, which is connected into the system to the gravity feed line or the collection chamber, and which is large in volume as compared to the collection chamber. The backwash receptacle of the invention is normally empty and the relatively large air volume thereof is available during each suction operation at a location close to the check valve so that only slightly more air is sucked through the upper part of the gravity feed line. Thus, disturbing noises associated with conventional systems are substantially eliminated.

Other features and advantages of the invention will be set forth in, or apparent from, the detailed description of the preferred embodiments found hereinbelow.

DESCRIPTION OF THE PREFERRED EMBODIMENTS

Figure 1:
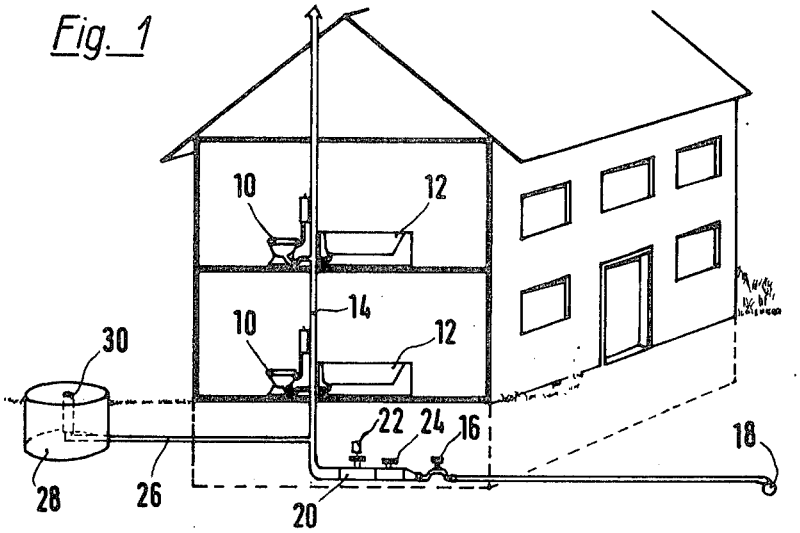
FIG. 1 is a highly schematic perspective view of a first embodiment of a vacuum-type water removal system according to the invention, wherein a backwash receptacle is disposed outside and is connected to a gravity feed line through a connecting conduit.

Referring to FIG. 1, a building is shown which includes sanitary facilities which are indicated at 10 and 12, and which can comprise a washing and flushing apparatus and the like. The facilities 10, 12 are connected to a vacuum waste water conduit 18 which is connected in a conventional manner to a vacuum station (not shown) from which the waste water is pumped, for example, to a clearing facility. The connection between facilities 10 and 12 and conduit 18 is effected through one or more gravity feed lines 14 which are vented in the customary way through the roof and through a conventional check valve 16. Check valve 16 is normally closed. The gravity feed line 14 is disposed upstream of valve 16 and includes a portion of enlarged cross section which constitutes a collector or collection chamber. In accordance with conventional practice, collection chamber 20 is designed to accept a relatively small quantity of water, e.g., a volume of water on the order of about 8 to 40 liters or slightly more. A control box 22 mounted on collection chamber 20 provides for opening of check valve 16 when a specific maximum water level is reached in collection chamber 20. An example of such a control box is described in German OS 2,455,551. A servicing valve 24 located on collection chamber 20 upstream of check valve 16 can be opened, for example, to remove objects that clog or block check valve 16.

A relatively large backwash receptacle 28 is located above the maximum normal water level of collection chamber 20 and is connected to gravity feed line 14 through a connecting conduit 26. The size of backwash receptacle 28 will ordinarily vary from several hundred liters up to several cubic meters. Backwash receptacle 28 may, for example, comprise a watertight vented pit in the ground outside the building. A heating oil tank may also be used for this purpose. In any case, the receptacle 28 should be sheltered from rain, and should be frostproof.

If check valve 16 is functioning normally, the waste water standing in collection chamber 20 will be drawn off with each opening operation. In order to provide proper operation of the vacuum system associated with vacuum conduit 18 it is important that, following the liquid, a quantity of air reaches vacuum conduit 18 through check valve 16, this quantity being a multiple of the liquid volume. This air, for the most part, will be sucked from the normally empty, vented backwash receptacle 28, particularly where connecting conduit 26 presents little flow resistance. For this reason, conduit 26 is advantageously made with a relatively large cross section. This has the added advantage that the possible backwash volume provided is also correspondingly enlarged.

If for any reason check valve 16 is not functioning properly, e.g. because of clogging or blockage, or if the control box 22 is not operating properly, the waste water flowing back through connecting conduit 26 will be dammed up and diverted back into backwash receptacle 28. Receptacle 28 can collect a relatively large amount of waste water without any damage. Advantageously, backwash receptacle 28 is disposed below the discharge openings of sanitary facilities 10,12 (which are not necessarily provided with check valves) so that even if the backwash receptacle 28 is not large enough to catch the collecting water in time, this water will spill outside over the edge or backwash receptacle 28 and not overflow into the house or building. Below the upper edge of backwash receptacle 28, waste water discharge openings, as provided in the cellar for example, must be secured by a special check valve.

If, because of clogging of check valve 16, backwash receptacle 28 is filled before opening the servicing valve 24, any backflow out of backwash receptacle 28 must be blocked. To this end, a normally open slide valve can be provided in connecting conduit 26 which is closed only in this situation. However, such an approach is relatively expensive. In a preferred embodiment, connecting conduit 26 is designed to open in the base or floor of backwash receptacle 28 in such a way that a standpipe 30 can be detachably inserted in the opening. Standpipe 30 can normally be engaged in this outlet opening of conduit 26 and thus prevent backflow from backwash receptacle 28 until the damage to check valve 16 has been rectified. Accordingly, standpipe 30 will be utilized only temporarily to provide emptying backwash receptacle 28. Alternatively, standpipe 30 could normally be stored inside or outside the backwash receptacle 28 and only inserted in the outlet opening of connecting conduit 26 during the opening of servicing valve 24.

Figure 2:
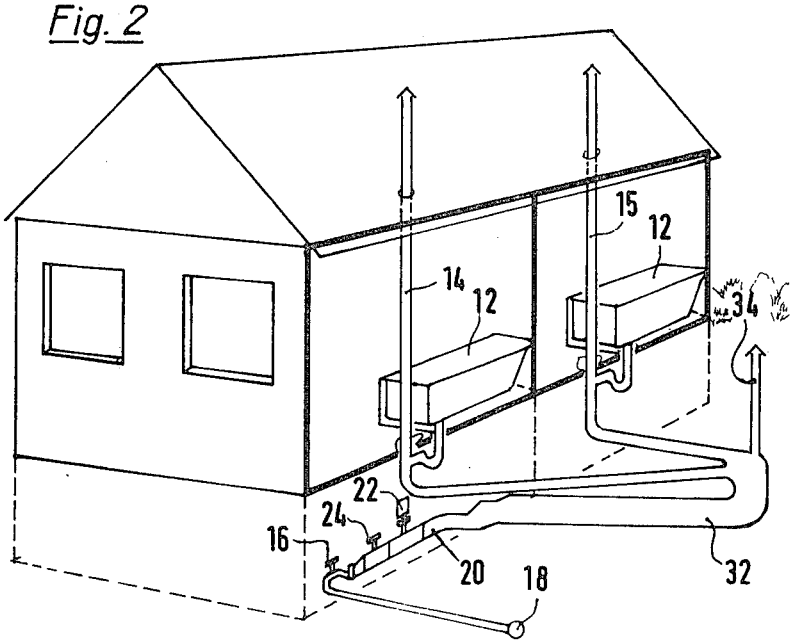
FIG. 2 is a highly schematic perspective view of a second embodiment of a vacuum water removal system according to the invention, wherein the backwash receptacle is part of a gravity feed line.

Referring to FIG. 2, a backwash receptacle is formed by an enlarged section 32 of gravity feed line 14. A further gravity feed line 15 is provided in this embodiment, the two lines being joined at the common enlarged section 32. Receptacle 32 can be provided, for example, in the form of a relatively long conduit having large cross section. As in the previous embodiment, venting, indicated at 34, is provided for backwash receptacle 32. Collection chamber 20, together with control box 22, servicing valve 24 and check valve 16, can be installed in the cellar of the building or in a pit in the ground outside the building. Backwash receptacle 32 is again located at a level above collection chamber 20.

Figure 3:
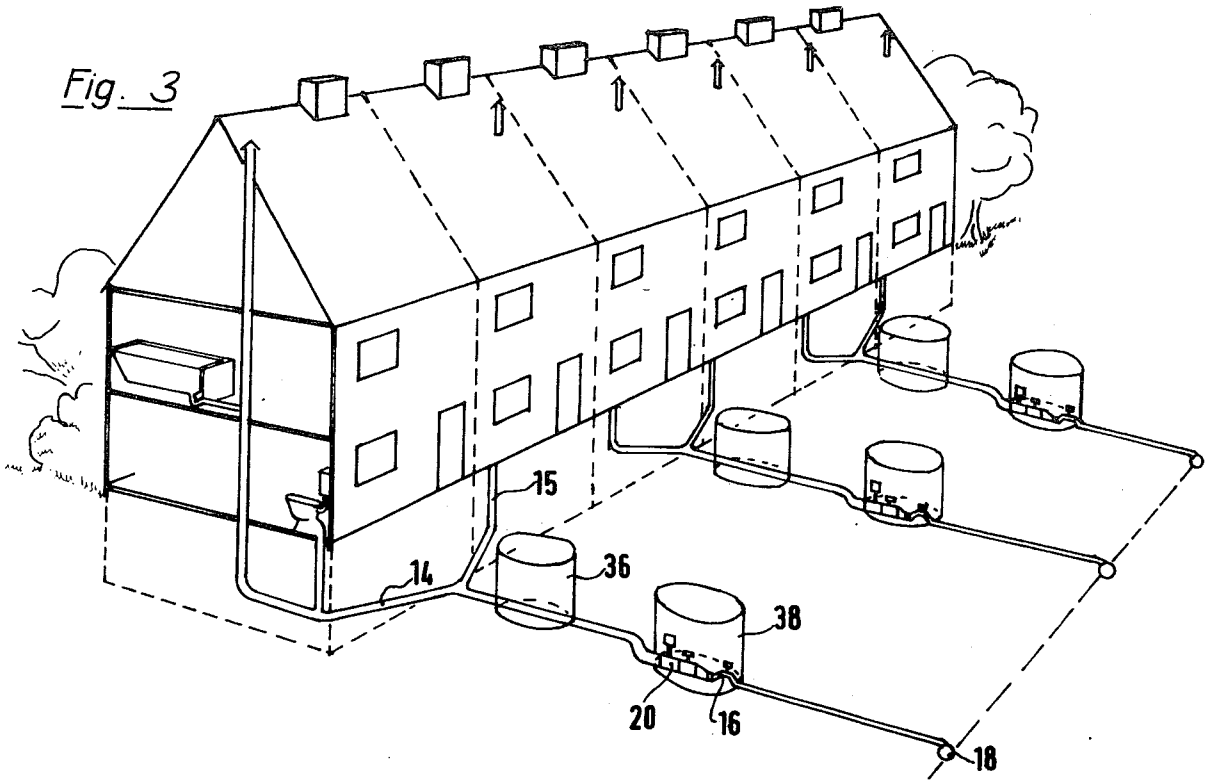
FIG. 3 is a highly schematic perspective view of a third embodiment of the system of the invention as incorporated in a row-house environment, and wherein two such row-houses have a check valve and a backwash receptacle in common, both of which are installed outside.

Referring to FIG. 3, a further embodiment is illustrated which is distinguished from that of FIG. 2 basically only in that the backwash receptacle, denoted 36 here, has the form of a watertight covered pit in the ground. Pit 36 has associated intake and outlet openings and, advantageously, a standpipe such as provided in FIG. 1, can be set into the outlet opening. In normal operation the waste water flows through the vented backwash pit 36 and is collected in collection chamber 20 which is at a lower level upstream of the check valve 16. Check valve 16 and chamber 20 are also installed in a pit 38 located outside of the building. The operation of the system of FIG. 3 is as described above.

Although the invention has been described relative to exemplary embodiments thereof, it will be understood that other variations and modifications can be effected in these embodiments without departing from the scope and spirit of the invention.

I claim:

1. In a vacuum water removal system for buildings wherein waste water collected from facilities in the building is fed by gravity feed lines to a collection chamber connected to a vacuum line for removal of the collected waste water and wherein a check valve is connected between said collection chamber and said vacuum line which opens automatically when a predetermined maximum water level is reached, the improvement wherein a vented backwash receptacle is included in said system in fluid communication therewith at a location above the maximum water level in the collection chamber and below the facilities from which waste water is collected, the volume of said backwash receptacle being large as compared with that of said collection chamber.

2. A vacuum water removal system as claimed in claim 1 wherein said backwash receptacle is connected to said collection chamber.

3. A vacuum water removal system as claimed in claim 1 wherein said backwash receptacle is connected to a said gravity feed line.

4. A vacuum water removal system as claimed in claim 1 wherein said backwash receptacle is located outside of the building in which the majority of said system is located, said system further including a connecting conduit for connecting said backwash receptacle to said system, said connecting conduit communicating with said backwash receptacle through the base of said backwash receptacle and being connected to a further, normally open check valve.

5. A vacuum water removal system as claimed in claim 4 wherein said further check valve comprises a standpipe.

6. A vacuum water removal system as claimed in claim 5 wherein said standpipe comprises a detachable standpipe which is detachably insertable in the outlet opening of the backwash receptacle.

7. A vacuum water removal system as claimed in claim 1 wherein said backwash chamber is part of a said gravity feed line and a further normally open check valve is connected between said gravity feed line and the first mentioned check valve.

8. A vacuum water removal system as claimed in claim 7 wherein said backwash receptacle comprises an enlarged section of said gravity feed line.

9. A vacuum water removal system as claimed in claim 7 wherein said further valve comprises a standpipe.

10. A vacuum water removal system as claimed in claim 7 wherein said backwash receptacle and said first mentioned feed line are disposed in pits in the ground outside of the builidng in which the facilities of the system are located.

* * * * *